United States Patent [19]

Sebel

[11] 4,341,419

[45] Jul. 27, 1982

[54] STACKABLE CHAIR WITH ARM RESTS

[76] Inventor: Harry Sebel, 96 Canterbury Rd., Bankstown, New South Wales 2200, Australia

[21] Appl. No.: 179,456

[22] Filed: Aug. 19, 1980

Related U.S. Application Data

[63] Continuation-in-part of Ser. No. 970,328, Dec. 18, 1978, abandoned.

[30] Foreign Application Priority Data

Dec. 19, 1977 [AU] Australia ..... PD2817

[51] Int. Cl.[3] ..... A47C 3/04

[52] U.S. Cl. ..... 297/239; 297/248; 297/DIG. 2

[58] Field of Search ..... 297/239, 248, DIG. 2

[56] References Cited

U.S. PATENT DOCUMENTS

| | | | |
|---|---|---|---|
| 2,699,814 | 1/1955 | Kahn | 297/239 |
| 2,990,876 | 7/1961 | Brook | 297/239 |
| 3,600,036 | 8/1971 | Iskander | 297/239 |
| 3,604,749 | 9/1971 | Parmett | 297/239 |
| 3,669,497 | 6/1972 | Massonnet | 297/248 |
| 3,784,251 | 1/1974 | Persson et al. | 297/239 |
| 3,827,749 | 8/1974 | Johnson et al. | 297/248 |
| 3,874,726 | 4/1975 | Sebel et al. | 297/239 |

FOREIGN PATENT DOCUMENTS

| | | | |
|---|---|---|---|
| 2035974 | 1/1972 | Fed. Rep. of Germany | 297/239 |
| 822162 | 12/1937 | France | 297/239 |
| 98011 | 3/1961 | Norway | 297/239 |
| 487416 | 6/1938 | United Kingdom | 297/248 |

*Primary Examiner*—Francis K. Zugel

*Attorney, Agent, or Firm*—Robert E. Burns; Emmanuel J. Lobato; Bruce L. Adams

[57] ABSTRACT

A stackable chair moulded in one piece from plastic material has a seat, a back, front legs, rear legs and right and left arm rests. The legs are formed with outwardly directed channels, the forward edge portion of each rear leg and the rearward edge portion of each front leg, being extended upwardly beyond the seat to form rearward and forward portions of the corresponding arm rests. The arm rests are of downwardy opening U-shape cross section and one is slightly narrower, lower and shorter than the other so that the arm rests can nest with arm rests of adjacent chairs to link the chairs together in a row.

11 Claims, 14 Drawing Figures

1
2
3
4
5
6
7
8
9
10
11
12
13
15
16
17
18
20
21
22
23

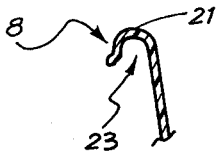
FIG. 5
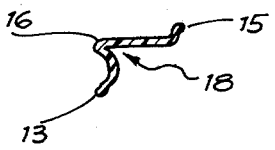
FIG. 6
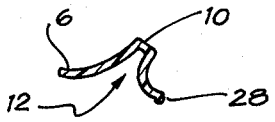
FIG. 7
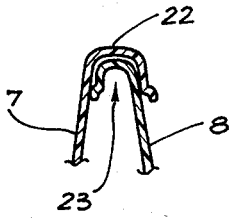
FIG. 11
FIG. 13
FIG. 14
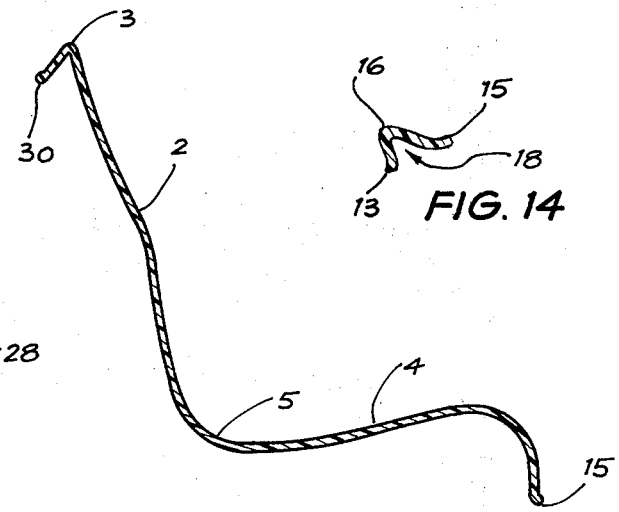
FIG. 12

STACKABLE CHAIR WITH ARM RESTS

REFERENCE TO PRIOR APPLICATION

This application is a continuation-in-part of application Ser. No. 970,328 filed Dec. 18, 1978 now abandoned.

The present invention relates to chairs and in particular to chairs which are able to be stacked and which include arms or arm rests.

Side chairs, that is chairs without arms, which are able to be stacked are well known, Australian Pat. No. 472,411 (U.S. Pat. No. 3,874,726) describing such a chair which has many practical advantages. However all stacking chairs do not make provision for arms or arm rests because these portions interfere with the stacking arrangement and, in particular, would increase the stacking height of the chairs.

Chairs which have arm rests are desirable for many applications since arm rests reduce the fatigue of the person sitting in the chair and therefore increase the ability of the sitter to concentrate. Accordingly chairs having arm rests are favoured for many lecture and concert halls.

It is therefore one object of the present invention to provide a chair having arm rests which is able to be stacked.

According to one aspect of the present invention there is provided a stackable armchair moulded in a single piece from plastics material, said armchair comprising a seat, a back, front legs, rear legs, and a left arm rest and right arm rest respectively positioned at the corresponding sides of said seat, each of said legs having an outwardly directed channel therein extending along substantially the length thereof and defining rearward and forward edge portions for each of said legs, the forward edge portion of each of said rear legs and the rearward edge portion of each of said forward legs extending upwardly beyond said seat at opposite sides of said seat to form rearward and forward portions of the corresponding arm rest, each arm rest having a downwardly opening substantially U-shaped trough extending between said upwardly extending leg portions and forming the top of the arm rest, the transverse cross sectional shape of each said trough being substantially the same, said rearward edge portions of said rear legs being extended upwardly to form the sides of said back, and said arm rests being connected with said back only by said seat.

At times multi-purpose public halls need to arrange chairs in rows, for example when a lecture is being given. At other times the chairs should not be rowed, for example when seating around a number of tables is required. Therefore the chairs idealy should be individual chairs which are separate from each other. However, when the chairs are arranged in rows it is desirable to provide some means for linking the chairs together so as to maintain the chairs in a row, despite the actions of any individuals seated in the chairs. Furthermore in some jurisdictions, it is a legal requirement that chairs, when set in rows, be linked together in groups of not less than, say four. Such legal requirements are primarily intended to meet possible panic conditions, and prevent individual chairs being upset, or pushed so as to block a row or an aisle, if panic conditions occur.

Numerous means have been used in the past for linking chairs in rows, but these have been generally clumsy, or expensive, or not very effective. In some cases vertical plates having holes are attached to a tubular metal frame, and a horizontal rod is threaded through the hole of each plate to link a group of chairs. It has also been proposed to use a separate horizontal cradle over which a number of chairs can be straddled, and to use external links or bolted connections.

In the preferred embodiment of the present invention, to be described hereinafter with reference to the drawings, there is disclosed a chair which not only has arm rests and is able to be stacked but is also able to be linked together with like chairs to form rows. The arm rests of such chairs are especially modified to provide the necessary linking means.

In the preferred embodiment the chair is moulded in a single piece from plastics material such as polypropylene. However the present invention is not so restricted and chairs in accordance with the invention may be moulded from other plastics or pressed from sheet plastic, or built up from fibre-glass and synthetic resin.

Figures 1, 2:
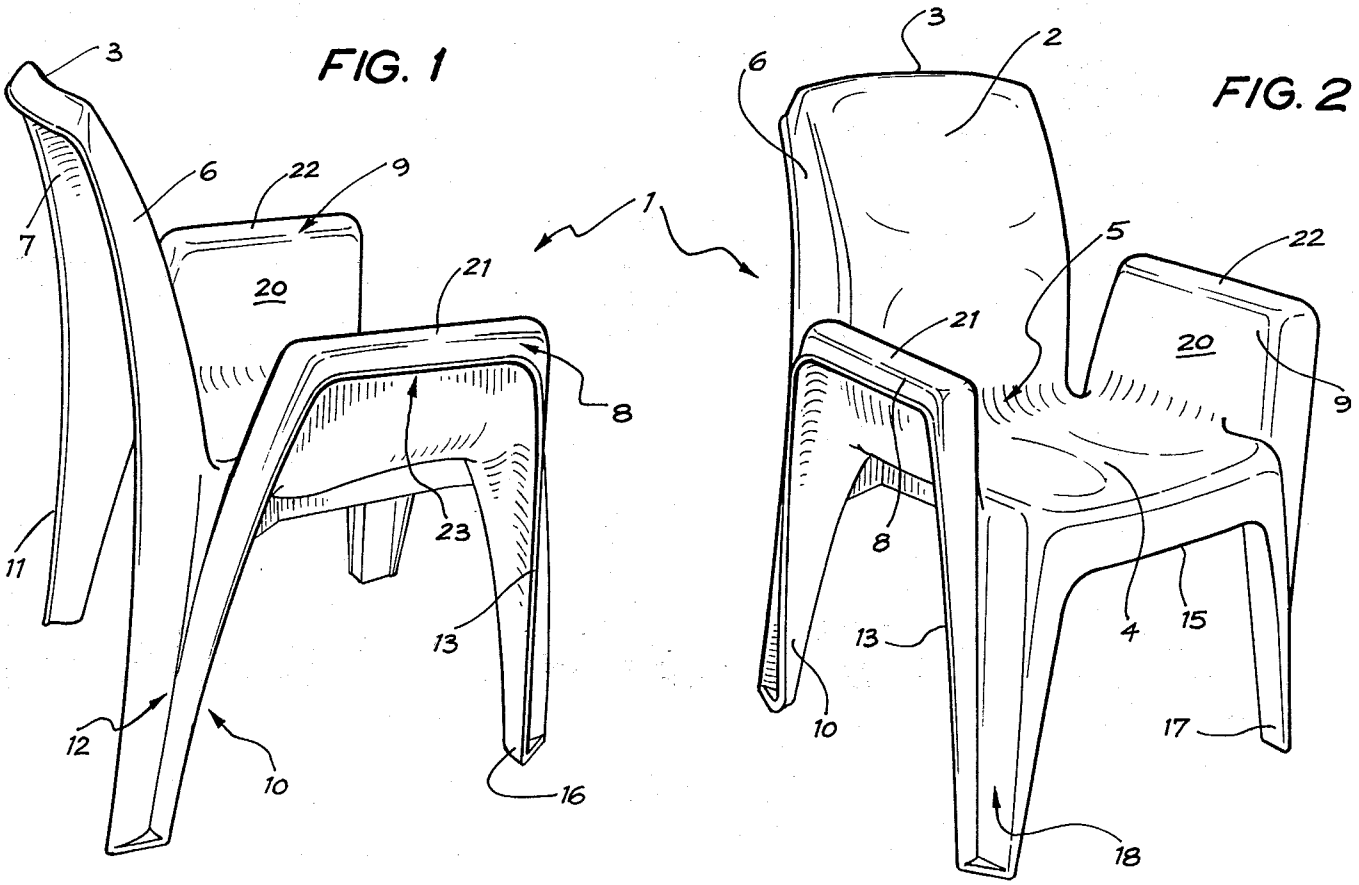
FIG. 1 is a rear perspective view of the chair of the preferred embodiment.
FIG. 2 is a front perspective view of the chair of FIG. 1.
Figure 4:
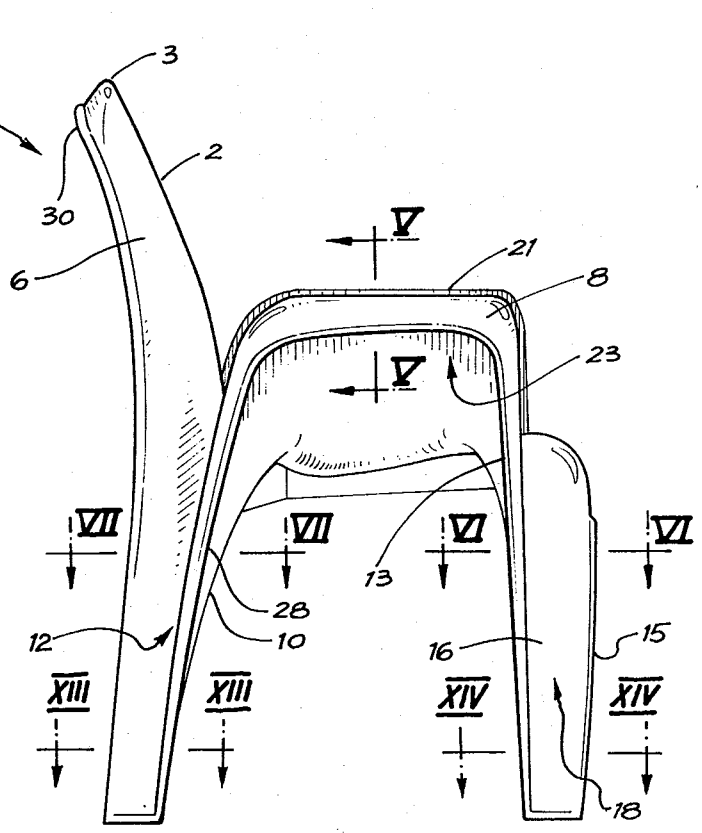
FIG. 4 is a right side elevation of the chair of FIG. 1.
Figure 3:
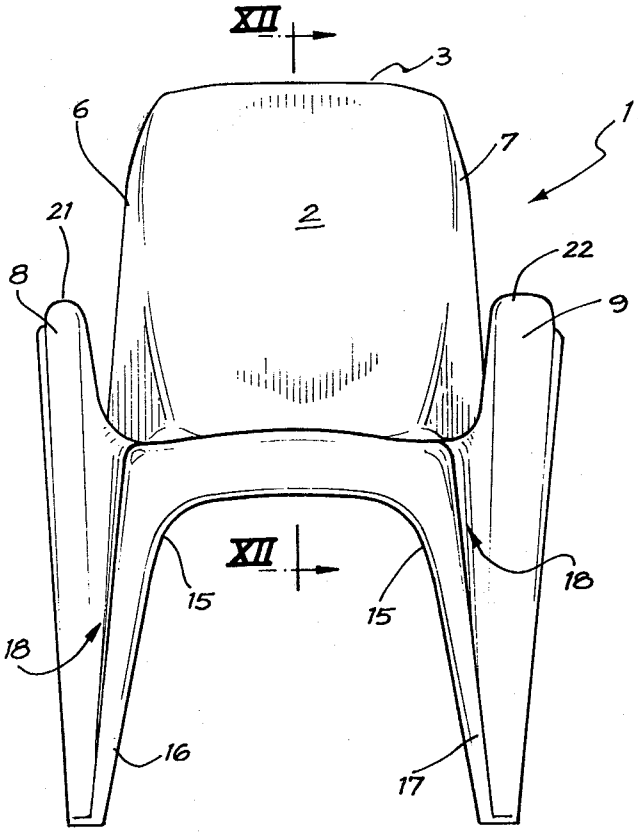
FIG. 3 is a front elevation of the chair of FIG. 1.
Figure 9:
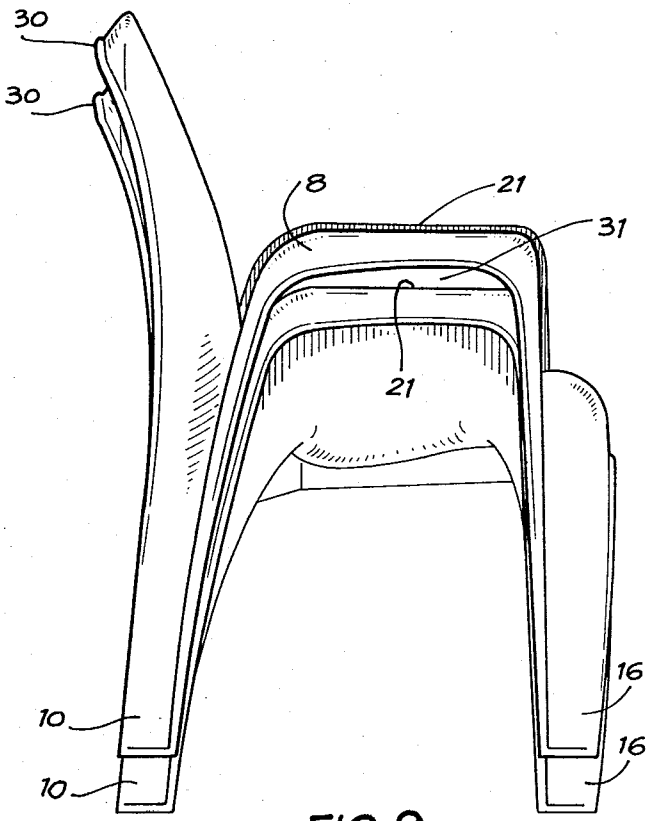
Figure 8:
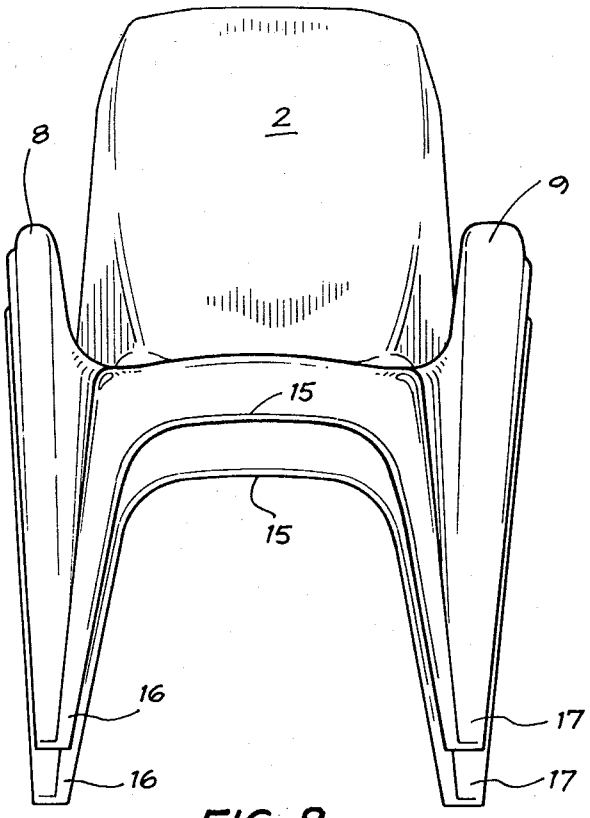
Figure 10:
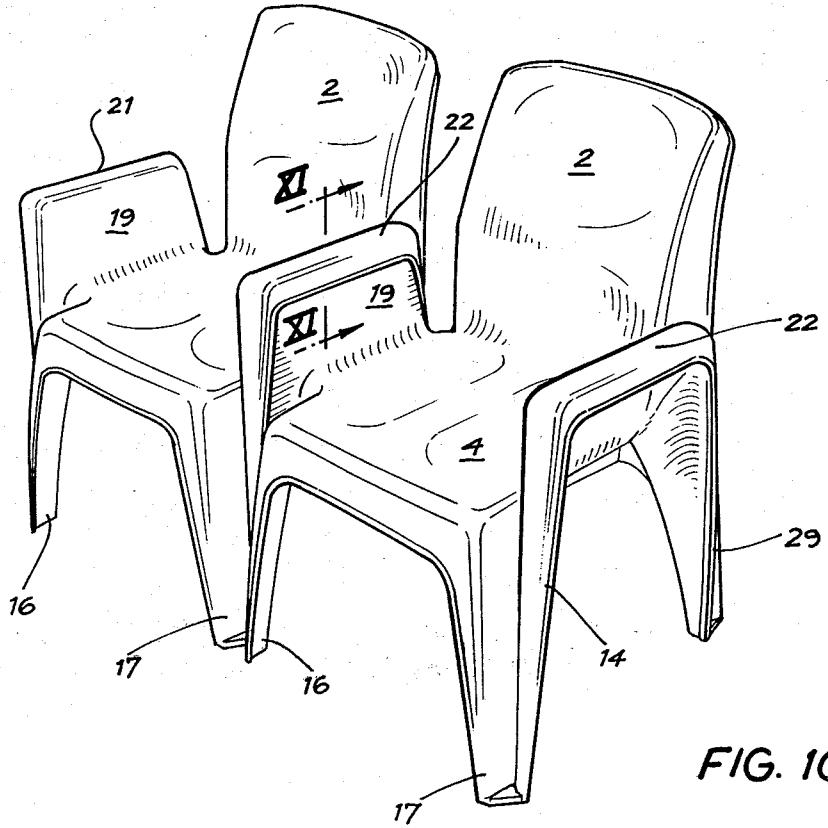

FIG. 5 is a cross-sectional view of an arm rest taken along the line V—V of FIG. 4, FIG. 6 is a transverse cross-sectional view of the upper portion of a front leg taken along the line VI—VI of FIG. 4, FIG. 7 is a transverse cross-sectional view of the upper portion of a rear leg taken along the line VII—VII of FIG. 4, FIG. 8 is a view similar to FIG. 3 but showing two chairs of the preferred embodiment stacked one upon the other, FIG. 9 is a right side elevation of the chairs of FIG. 8, FIG. 10 is a front perspective view from the left showing the chairs of FIG. 8 alongside each other and linked to form a row, FIG. 11 is a transverse cross-sectional view of the linked arm rests taken along the line XI—XI of FIG. 10, FIG. 12 is a longitudinal cross-sectional view of the chair taken along the line XII—XII of FIG. 3, FIG. 13 is a transverse, cross-sectional view of the lower portion of a rear leg taken along the line XIII—XIII of FIG. 4, and FIG. 14 is a transverse cross-sectional view of the lower portion of a front leg taken along the line XIV—XIV of FIG. 14.

The chair 1 illustrated in the drawings is moulded from polypropylene by injection moulding. The back 2 as seen in FIGS. 4 and 12 tapers outwardly from its top 3 to where it joins the seat 4 at 5. The back 2 is rolled over both at the top 3 for strengthening purposes and to provide a hand grip 30, and, to a lesser extent, along the outside edges 6 and 7 of the back 2. The outside edges 6 and 7 of the back 2 are continued downwardly below the seat 4, and combine with rear and downward extensions 28 and 29 of the arm rests 8 and 9 to form the rear legs 10 and 11 respectively. The rear legs 10 and 11 taper from top to bottom, and there is a deep re-entrant portion or channel 12 to give added strength to the rear legs 10 and 11. The seat 4 at its front edge 15 is turned downwardly through nearly a right angle. This turned over front edge 15 is extended downwardly in a smooth curve to combine with downward extensions 13 and 14 of the arm rests 8 and 9 to form the front legs 16 and 17 respectively. The front legs 16 and 17 taper from top to bottom and have channels 18 between the front edge 15 and the arm rest downward extensions 13 and 14. The channels 18 give added strength to the front legs 16 and 17.

The sides of the seat 4 merge into the inner faces 19 and 20 of the arm rests 8 and 9 respectively. The arm rests 8 and 9 are directed outwardly from the seat at a small angle, as best seen in FIG. 3. In addition, the arm rests 8 and 9 taper somewhat from bottom to top. As seen in FIGS. 5 and 11, the tops 21 and 22 of the arm rests 8 and 9 are each rolled over outwardly to form downwardly opening troughs 23 and 24 respectively.

One arm rest 9, the lefthand arm rest which supports the left arm of the sitter, is made slightly higher than the righthand arm rest 8 by an appropriate amount, say ¼ inch, and the trough 24 at the top of the lefthand arm rest 9 is also made slightly wider, say ¼ inch, than the righthand trough 23. In addition, the righthand arm rest 8 is made slightly shorter than the lefthand arm rest 9 so that trough 24 is slightly longer than arm rest 8. Therefore when two chairs are placed side by side, as seen in FIG. 10, the righthand chair, viewed from the rear, can be lowered onto the lefthand chair so that the lefthand arm rest 9 of the righthand chair fits over the top of the righthand arm rest 8 of the lefthand chair. In this way the two chairs are linked together in side by side relation-other chairs can be added similarly to form a row of chairs.

An advantage of this construction is that it can be arranged so that a substantial vertical movement is necessary to disconnect two linked chairs, thereby preventing involuntary unlinking of chairs in a row during panic situations. It also avoids the need for external links or protruberances, and the need for any fixing tools. Also floor space is conserved by actually requiring less area for chairs with arms when secured by overlapping as described above than is required when the identical chairs are set normally side by side. These advantages are obtained without affecting the chair stacking space and also without the need for any attachments or tools.

When two chairs are stacked one above another, as seen in FIGS. 8 and 9, the rear legs 10 and 11 of the upper chair fit in the channels 12 of the lower chair. Also the front legs 16 and 17 of the upper chair fit into the channels 18 of the front legs 16 and 17 of the lower chair. This fitting arrangement determines the stacking height. The arm rests 8 and 9 of the lower chair are aligned with the corresponding troughs 23 and 24 of the upper chair. There will normally be some protrusion of at least the front and rear ends of the arm rests 8 and 9 of the lower chair into the front and rear ends of the corresponding troughs 23 and 24 of the upper chair. However, depending upon the actual stacking height there will normally be a clearance 31 between the top of the lower arm rests and the opening of the troughs immediately above. Alternatively, the lower arm rests may partially enter into the troughs above.

Preferably the chairs are provided with integrally moulded glides. However, alternatively the chair legs can each be fitted with a moulded plastic inverted dome which clips or screws into the bottom of the leg to form a glide. The height of the chair can thereby be increased by clipping or screwing further domes into or onto domes already positioned. Thus the chair can be adjusted for a more upright or conversely a more reclining posture by adding domes to back or front legs respectively or, a mid posture can be maintained in the absence of a thickness of upholstery or pad upon the seat by adding the domes to all four legs of the chair. Naturally the above described moulded glides can be dimensioned as required for any desired posture.

In the chair described and illustrated there are no bridging pieces, on struts or webs to give added strength which would, however, prevent or restrict stacking. However, if the stacking height is to be, say, 2 inches, any bridging pieces, struts or webs which may be required can be placed across the channels in the legs at, up to 2 inches above the bottom of the back legs to determine the position of the chair above when stacked. In addition stiffening ribs or gussets can provide structural stiffness on other than vertical or near vertical surfaces, providing the stacking centres are not exceeded.

The chair of the preferred embodiment is open between the legs at both the front and the rear and also at the sides thereby reducing restriction to cleaning. The front opening permits the feet to be positioned underneath the chair while the rear opening permits the sitter's legs to be extended with the feet positioned under the corresponding seat of the row immediately in front.

In the chair described in detail above the trough 23 and 24 have both ends closed off. The shape of the troughs 23 and 24 prevents relative movement in the row direction, and the closed ends prevent relative movement at right angles to the row. However, it is also possible to utilize the trough shape to prevent movement in the row direction, while leaving one or both ends open, and providing other locking means for preventing movement at right angles to the row. For example the front of the arm rest may be closed and the back open, so that one chair can be pushed horizontally onto another until the closed front ends abut and prevent further movement. The rear ends of the arm rests can then be joined by a pin, a spring detent action, a bolt or any other suitable means.

The foregoing describes only some embodiments of the present invention and modifications, obvious to those skilled in the art, may be made thereto, without departing from the scope of the present invention.

What is claimed is:

1. A stackable armchair moulded in a single piece from plastics material, said armchair comprising a seat, a back, front legs, rear legs, and a left arm rest and right arm rest respectively positioned at the corresponding sides of said seat, each of said legs having an outwardly directed channel therein extending along substantially the length thereof and defining rearward and forward edge portions for each of said legs, the forward edge portion of each of said rear legs and the rearward edge portion of each of said forward legs extending upwardly beyond said seat at opposite sides of said seat to form rearward and forward portions of the corresponding arm rest, each arm rest having a downwardly opening substantially U-shaped trough extending between said upwardly extending leg portions and forming the top of the arm rest, one armrest and corresponding trough being slightly narrower than the other arm rest and corresponding trough so that the narrower arm rest of one chair will fit in the wider arm rest of an adjacent chair, said rearward edge portions of said rear legs being extended upwardly to form the sides of said back, and said arm rests being connected with said back only by said seat.

2. A stackable armchair as claimed in claim 1, wherein the top of said back is rolled over to form a channel opening downwards and to the rear of said back.

3. A stackable armchair as claimed in claim 1, wherein the trough of each arm rest is closed at both ends.

4. A stackable armchair as claimed in claim 3, wherein the trough of the narrower arm rest is slightly shorter in length than the trough of the wider arm rest.

5. A stackable armchair according to claim 1, wherein said narrower arm rest is slightly lower than said wider arm rest.

6. A stackable armchair as claimed in claim 1 wherein the trough of each arm rest is closed at both ends, the trough of the narrower arm rest is slightly shorter in length than the trough of the wider arm rest, and said narrower arm rest is slightly lower than said wider arm rest.

7. A stackable armchair as claimed in claim 1, formed from fibre-glass and synthetic resin.

8. A stackable armchair as claimed in claim 1, injection moulded from polypropylene.

9. A stackable armchair according to claim 1, wherein opposite sides of the seat extend upwardly to said U-shaped trough of said arm rests respectively between said upwardly extending portions of said legs forming rearward and forward portions of said arm rests.

10. A stackable armchair as claimed in claim 1 and being able to be stacked above a like armchair with each arm rest of the lower armchair being located below the trough of the corresponding arm rest of the upper armchair.

11. A stackable armchair as claimed in claim 1 and being able to be stacked above a like armchair with each leg of the upper armchair being received in the outwardly directed channel of the corresponding leg of the lower armchair.

* * * * *